US005547053A

United States Patent [19]

Liang

[11] Patent Number: 5,547,053

[45] Date of Patent: Aug. 20, 1996

[54] SPRING LOADED LUGGAGE HANDLE

[76] Inventor: Joseph Liang, P.O. Box 1060, Alpine, N.J. 07620

[21] Appl. No.: 303,062

[22] Filed: Sep. 8, 1994

[51] Int. Cl.[6] ..... A45C 13/26

[52] U.S. Cl. ..... 190/115; 190/39; 190/18 A; 16/115

[58] Field of Search ..... 280/37, 655, 655.1; 16/115, 110 R; 190/18 A, 115, 39

[56] References Cited

U.S. PATENT DOCUMENTS

| | | | |
|---|---|---|---|
| 1,612,446 | 12/1926 | Larson | 16/115 |
| 2,392,926 | 1/1946 | Kelly | 190/115 |
| 2,490,947 | 12/1949 | Coffing | 16/115 X |
| 4,062,429 | 12/1977 | Tabor et al. | 190/18 A |
| 4,358,005 | 11/1982 | Fontana | 190/18 A |
| 4,838,396 | 6/1989 | Krenzel | 190/18 A |
| 4,969,660 | 11/1990 | Spak | 280/655 X |
| 5,178,244 | 1/1993 | Liang | 190/18 A |
| 5,197,579 | 3/1993 | Bieber et al. | 190/18 A |
| 5,269,044 | 12/1993 | Marion | 16/115 X |
| 5,339,934 | 8/1994 | Liang | 190/18 A |

FOREIGN PATENT DOCUMENTS

| | | | |
|---|---|---|---|
| 2253358 | 5/1974 | Germany | 190/18 A |
| 2270900 | 3/1994 | United Kingdom | 190/18 A |

*Primary Examiner*—Sue A. Weaver
*Attorney, Agent, or Firm*—Cohen, Pontani, Lieberman, Pavane

[57] ABSTRACT

A retractable handle apparatus for user-defined selective movement of an article of luggage along an underlying ground or supporting surface includes an elongate rigid graspable portion secured to a front wall surface of the article by a flexible portion that is coupled to the rigid portion. The flexible portion permit multi-directional pivotal and axially rotative movement of the graspable portion relative to the fixed front wall surface. A spring assembly extending along the flexible portion provides automatic return of the graspable portion to an initial position of nonuse when the handle is released by the user.

18 Claims, 6 Drawing Sheets

SPRING LOADED LUGGAGE HANDLE

FIELD OF THE INVENTION

The present invention relates to handles for moveable containers, such as articles of luggage, which are selectively moveable in a user-defined direction on and along an underlying supporting surface.

DESCRIPTION OF THE PRIOR ART

A traveller is often encumbered with more than one article of luggage which may be awkward or burdensome to carry. Thus, it is desirable to have a piece of luggage that may be pulled in a user-defined direction on and along an underlying ground or supporting surface. Furthermore, for a heavily laden traveller, or a traveller with a physical condition that makes bending or crouching close to the ground difficult, the placement or location of the handle to be grasped and pulled is very important. Accordingly, it is further desirable to have a graspable handle that is readily accessible to the user and which enables the traveller to pull the article of luggage along the supporting surface and, at the same time, to readily and selectively control the direction in which the article moves.

The prior art teaches numerous handle configurations for moveable containers, particularly for use with articles of luggage, which accordingly seek to enable users to selectively maneuver the container in a user-defined direction using a conveniently placed handle that does not require the user to bend or crouch close to the ground in order to grasp and retain the handle. These known constructions include, for example, rigid handles affixed to a side of the container and which are located at a convenient height from the underlying ground surface, or handles directly affixed to the top wall or surface of the luggage.

However, handle configurations that are mounted to a wall surface of the container at a significant distance from the underlying or supporting surface along which the container is movable, typically on or proximate the top wall of the container, present their own disadvantages. As is well understood in the art, the wall surface of the luggage article closest to the underlying supporting surface is often much longer in one direction than the other, i.e. the article has an elongated footprint. As a consequence, with a high-mounted handle it is much easier to unintentionally tip or overturn the luggage when it is pulled in a direction other than the then-existing direction of travel.

Other heretofore-known configurations, which conveniently place the handle in a position that does not require the user to bend or crouch close to the ground to grasp the handle, require that the user tilt the container into a position in which the user must also support a portion of the weight of the container and its contents to prevent its falling over. Furthermore, depending upon the dimensions of the container and the location on the wall surface to which the handle is mounted, the fundamental problems that result from high-mounting of the handle also become significant.

Additionally, even where the handle is mounted relatively close to the underlying supporting surface and the graspable end is placed where the user does not have to bend or crouch in order to grasp the handle, should the handle be inadvertently or otherwise released then the user may nonetheless have to bend or crouch to retrieve it.

SUMMARY OF THE INVENTION

It is accordingly an object of the present invention to provide a manipulable handle for a moveable container that allows for stable user-directed movement of the container as it is pulled on and along an underlying supporting surface.

It is a further object of the invention to provide a manipulable handle for a moveable container that is conveniently located at a significant distance from an underlying ground or supporting surface for easy grasping by the user.

It is a still further object of the invention to provide a manipulable handle for a moveable container that automatically returns from its user-manipulated position to a conveniently graspable position of nonuse when released by the user.

The needs currently unmet by the prior art are advantageously addressed by the present invention which relates to handles for moveable containers that are moveable in a user-defined direction along an underlying supporting surface and, more particularly, to a conveniently-placed handle for a moveable article of luggage and that is mountable to a wall of the article. The handle of the present invention has a graspable portion and a rigid portion and is pivotably manipulable, in more than one plane, from a first position to a second position and is additionally capable of axially rotational movement, all under the selective control of the user. The rigid portion of the handle is coupled to a movement-accommodating assembly that enables manipulation of the handle both pivotally and rotationally and which also operates to automatically return the handle from the second position to the first position when the handle is released from the user's grasp. The movement-accommodating assembly is also coupled to a supporting assembly which supports the handle and which is mounted on or coupled to or integrally formed with a wall or wall surface of the container.

In operation, the graspable portion is grasped by the user and is pivotally manipulated from the first position to the desired and user-defined second position which may be anywhere within a three-dimensional volume defined by the limits of travel of the graspable portion. The container may then be pulled (by exerting a pulling force on the handle) to selectively move or displace it in a user-defined direction along the underlying supporting surface. When the handle is released from a second position located within the volume, whether deliberately or inadvertently, the movement-accommodating assembly acts upon the handle to automatically return the handle from its second to its first position.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DETAILED DESCRIPTION OF THE DRAWINGS

In the drawings, wherein like reference characters denote similar elements throughout the several views.

DETAILED DESCRIPTION OF THE PREFERRED EMBODIMENTS

Figure 1:
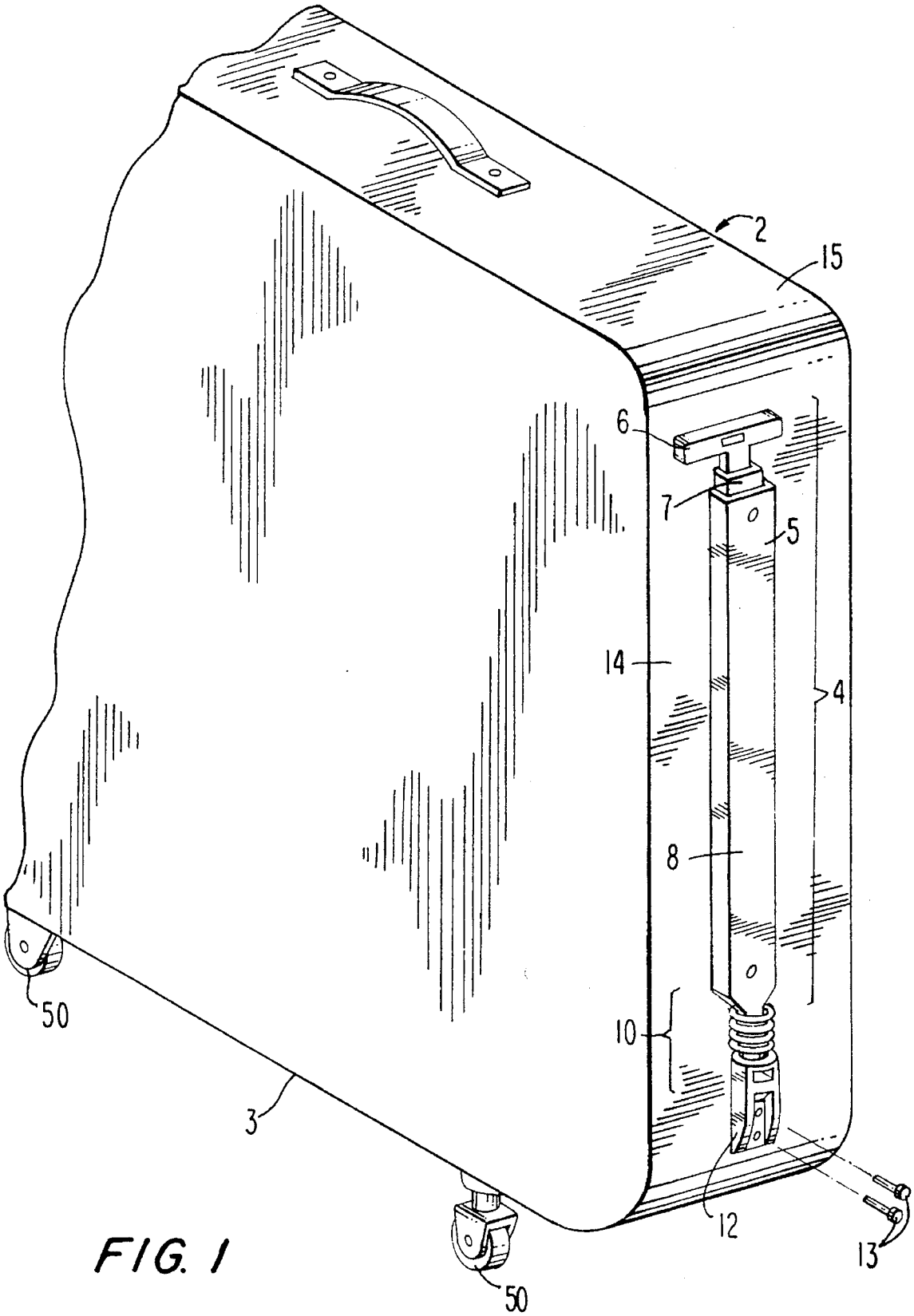
FIG. 1 is an elevated, perspective, partial view of an article of luggage having a handle constructed in accordance with the teachings of the present invention.

With particular reference to the drawings, FIG. 1 illustrates a moveable container 2 which, by way of preferred example, and as generally contemplated, is a suitcase or other article of luggage. The article of luggage 2, which will typically be provided on its bottom face or wall 3 with a plurality of depending casters and/or freely-rotatable (i.e. follower) wheels 50 for supporting the luggage 2 on and for user-initiated and controlled movement along an underlying ground or supporting surface, includes a handle 4 having a graspable portion 6 carried on the end of an elongated, rigid portion or member 8. The graspable portion 6 may, for example, be conveniently T-shaped so as to be comfortably graspable by the hand of a user for manipulation from a first or unmanipulated or normal or storage position of nonuse to a second position for selective pulling of the luggage 2 by the user. Alternatively, the handle may be of an ovoid shape and include an opening or cavity into which the user's fingers may be inserted to accomplish like functionality.

In a most preferred form of the invention, the elongated, rigid portion or member 8 is implemented by a plurality of concentrically nested, elongated rod or tube-like members which are relatively slidable to telescopically extend from a first or shortened position (seen in FIG. 1) in which the rods or tubes lie substantially one within the other to define a minimum length of the member 8, and a second or extended position (not shown) defining a maximum length of the member 8. As will be appreciated, although the rods or tubes are depicted in FIG. 1 as having a generally rectangular or cross-sectional configuration, they may alternatively have a substantially circular cross-sectional shape so as to additionally permit the rods or tubes—and most particularly that from which the graspable portion 6 depends—to axially rotate relative to the other rods or tubes of the member 8 to thereby further facilitate and enhance user-directed steering and guidance of the article of luggage 2 for movement on and along an underlying ground or supporting surface in a user-selected and user-controlled manner.

As will also be recognized, rollers of various types may be utilized in place of the illustrated wheels 50 and, in certain instances, one or more of the wheels 50 may be dispensed with if the bottom face of the luggage 2 is constructed so as to permit or facilitate sliding movement of the article along the underlying supporting surface. In addition, a conventional handle 9 may optionally be provided on an upper face or top wall 15 of the luggage 2 for the additional convenience of the user.

The inventive handle 4 further includes a movement-accommodating or movement assembly 10 for pivotal movement of the handle 4 in more than one plane and, additionally, for axially rotational movement of the elongated handle. A handle mounting or supporting assembly 12 is, as illustrated, implemented as a substantially unitary support member 12 that is secured to a forward-facing or front or leading wall surface 14 of the luggage, the wall surface 14 being located between and, in the illustrated article 2, spanningly connecting the top wall 15 and the bottom wall 3. The supporting assembly 12 which may, by way of example, be attached to the forward wall by rivets 13 or the like, is disposed along the vertically-elongated wall 14 at a location that is closer to the bottom wall 3 (and to the underlying supporting surface) than does the rigid portion 8 when the handle 4 is in its first or unmanipulated or normal or storage position. The supporting assembly 12 may alternatively be formed as an integral part of the forward or leading wall surface 14. The mounting assembly 12 both supports the handle 4 and transmits, from the handle 4 to the luggage 2, a pulling force that is selectively applied to the grasped handle 4 by the user.

The moveable handle of FIG. 1 is selectively manipulable by the user through a plurality of second positions defining a swept volume that approximates a half-hemisphere; FIGS. 2 and 2B show the handle 4 in various illustrative positions within this manipulable range which is depicted by volume A. As will be recognized, and as shown by way of example, the rigid handle portion 8 may optionally be constructed as an elongated outer sleeve 5 having a throughbore that is sized to accept one or more elongated and operatively telescoping shaft sections 7 so as to allow the handle to be selectively extendable for the further convenience of the user.

Figure 3:
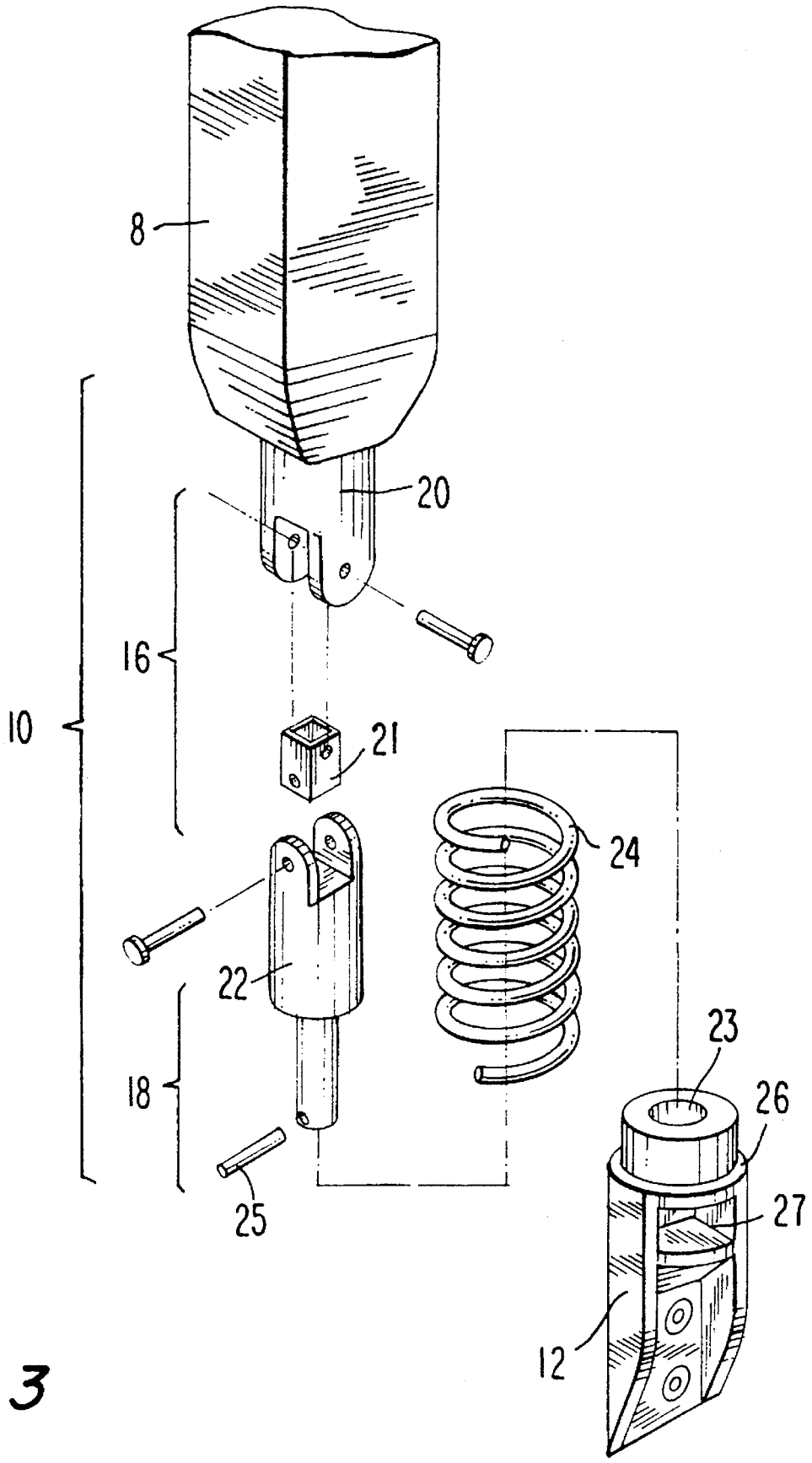
FIG. 3 is an elevated perspective exploded view of a first embodiment of the movement-accommodating assembly of the present invention.

FIG. 3 illustrates, in further detail, an exploded perspective view of a first embodiment of a movement assembly 10 constructed in accordance with the teachings of the invention. Rigid portion 8 and supporting assembly 12 are coupled one to the other so that the handle 8 can pivotably move with respect to the support 12. The movement assembly includes a coupler or returnable pivot such, for example, as a universal joint 16. A first shaft portion 20 of the universal joint 16 is unitarily or integrally formed with or otherwise secured to the rigid portion 8 of the handle 4. As illustrated, the universal joint 16 consists of a cooperating plurality of elements including the first shaft portion 20 having a substantially U-shaped channel, the arms or uprights of which are bored to accept a first cylindrical pin. A second shaft portion 22 forms the opposite end of the universal joint 16 and is similarly provided with a substantially U-shaped channel with bored arms or uprights to similarly accept a second cylindrical pin. Finally, a yoke or pivot block 21 of the joint 16 is interposed between and connects the first and second shaft portions 20, 22 for multi-directional pivotal movability therebetween. More particularly, the first shaft portion 20 is pinned to the yoke 21 and the second shaft portion 22 is similarly pinned to the yoke with the respective pins being oriented at a substantially 90° angle one to the other. The universal joint 16 is coupled to the support member 12 by a generally cylindrical rotation shaft 18 which is connected to, or integrally formed with, the second shaft portion 22 and, in the particular construction illustrated, has a diameter smaller than the outer diameter of the second shaft portion 22 from which it depends. The rotation shaft 18 is bored to accept a retention pin 25, and the support member 12 is further provided with a rotation bore 23 that is sized to accept the rotation shaft 18 therewithin. In the assembled condition of the handle 4, with the shaft 18 rotatively disposed in the bore 23, the pin 25 extends into and partly outwardly from the shaft 18 so as to project into the confines of a cutout 27 defined on the support member 12. The pin 25 thereby both captures the shaft 18 within and prevents its unintended withdrawal from the bore 23 and limits the range of axial rotation of the shaft 18 within and relative to the bore 23 through abutment of the outwardly projecting portion of the pin 25 with the transverse bounds of the cutout 27 in the support 12. Of course, and as will become apparent from the alternative embodiments described hereinbelow, other assemblies permitting pivotal and rotational movement of the rigid handle portion 8 may optionally be utilized in lieu of the universal joint 16.

Figure 2A:
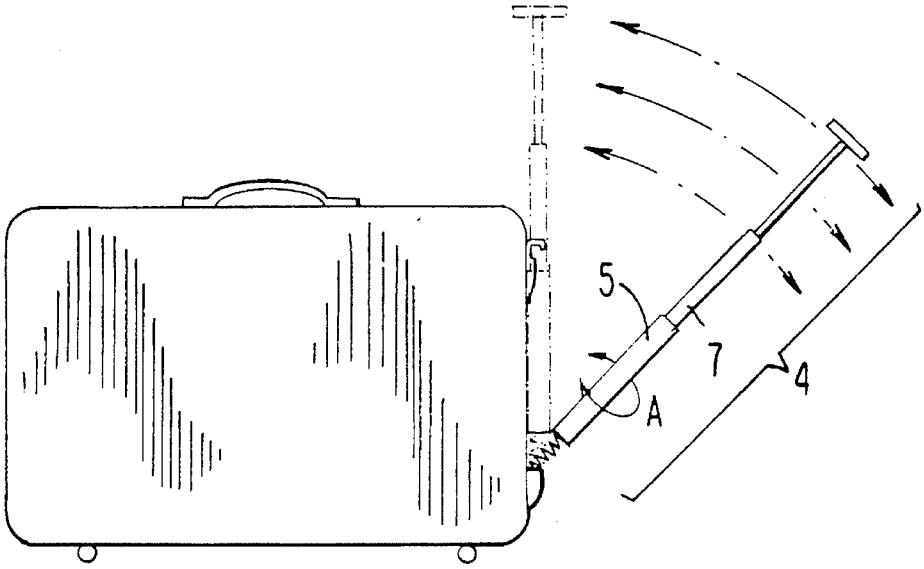
FIGS. 2A and 2B are side and end views, respectively, of an article of luggage bearing the handle of FIG. 1 which appears by way of example in various so-called second positions within its range of selective manipulation.
Figure 2B:
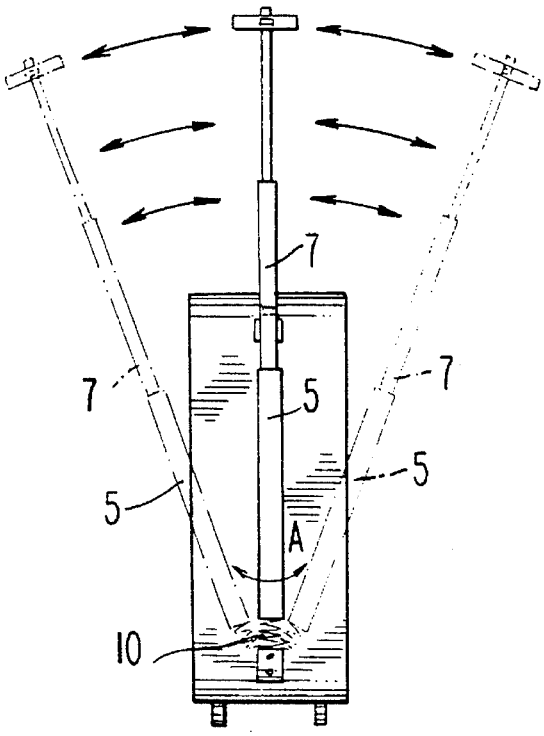

Thus, the movement assembly 10 allows the user to pivotably manipulate the handle from a first position of nonuse, shown in FIG. 1, to a virtually infinite variety of second positions which, as seen by way of example in FIGS. 2A and 2B, may lie anywhere within the extensive swept or sweepable volume A.

The movement assembly 10 is further constructed so as to automatically return the handle 4 to its unmanipulated position when released by the user. As shown in FIG. 3 (and currently preferred), the return urgency of an elongated coil spring 24 is utilized to achieve this functionality. The spring 24 is disposed so that one of its ends rests on or against a seat 26 defined or otherwise disposed or carried on the support 12 while the other or opposite end of the spring is seated against the rigid member or portion 8. The spring is further disposed radially outward from the returnable pivot such that, as shown, the continuous, spiraling coil that defines the spring circumferentially surrounds or envelops the universal joint 16. Thus, in the embodiment illustrated in FIG. 3 the spring is seated spanningly between the rigid portion 8 and the support member 12 with the universal joint 16 lying within the confines of the spring 24.

Figure 4A:
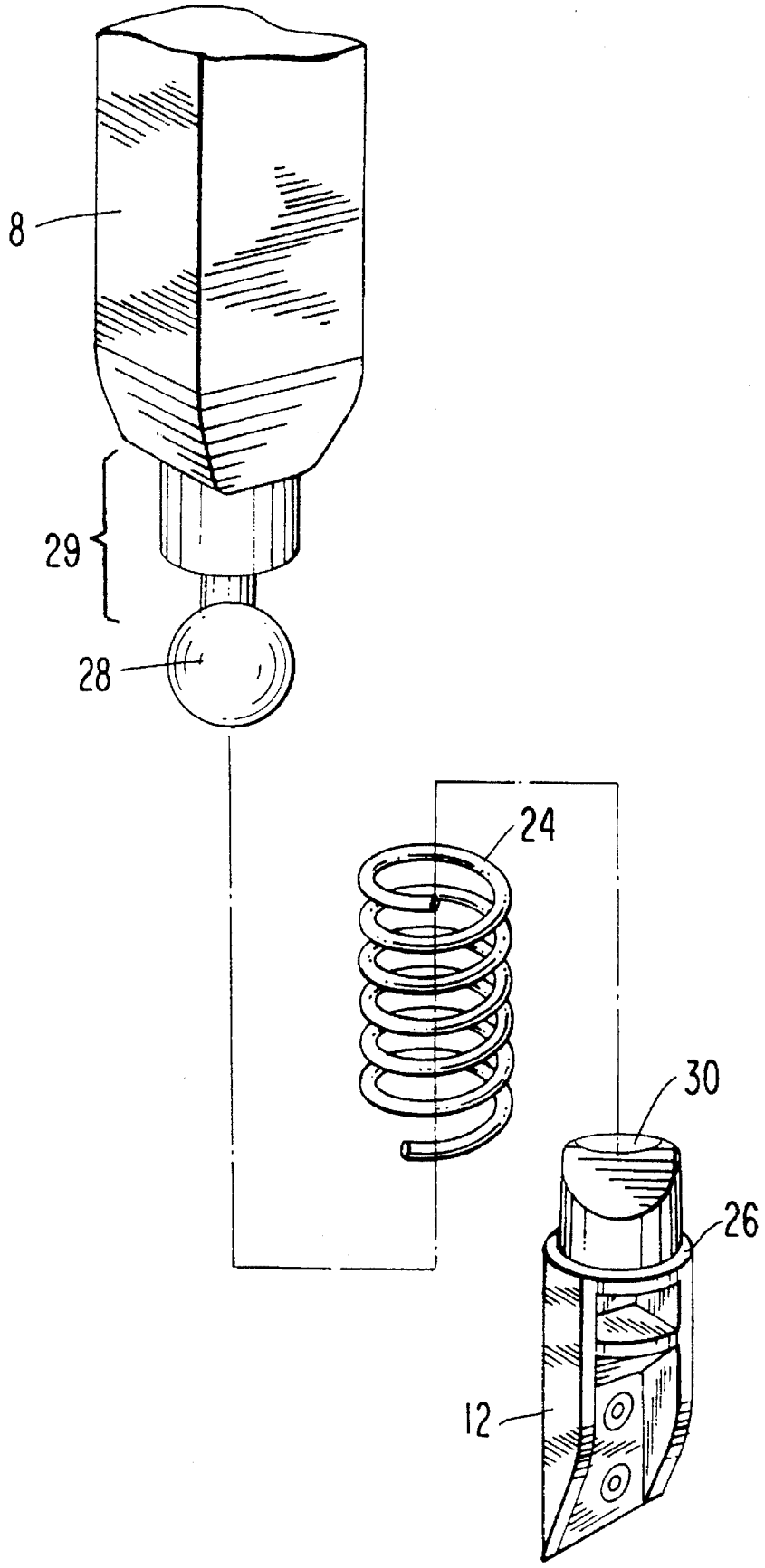
FIG. 4A is an elevated perspective exploded view of a second, alternative embodiment of the movement-accommodating assembly of the invention.

FIG. 4A depicts an alternate embodiment of the invention in which the returnable pivot functionality is implemented by a joint formed of a cooperating ball 28 and socket 30 in lieu of the universal joint 16 of FIG. 3. The ball and socket connection of FIG. 4A is constructed with the ball depending from the rigid portion 8 by a shaft 29 which, as shown, is stepped but which may instead be tapered or of uniform diameter or cross-section along its length. The socket 30 is connected to or integrally formed on support member 12 and is configured and sized to accommodate the ball 28 therewithin so as to permit the desired pivotal and rotational movement of the rigid portion 8 relative to the support member 12. An elongated coil spring 24 is disposed radially outward from and circumferentially about the ball and socket 28, 30 so that the ball and socket connection is operatively situate within the peripheral bounds of the spring 24.

Figure 4B:
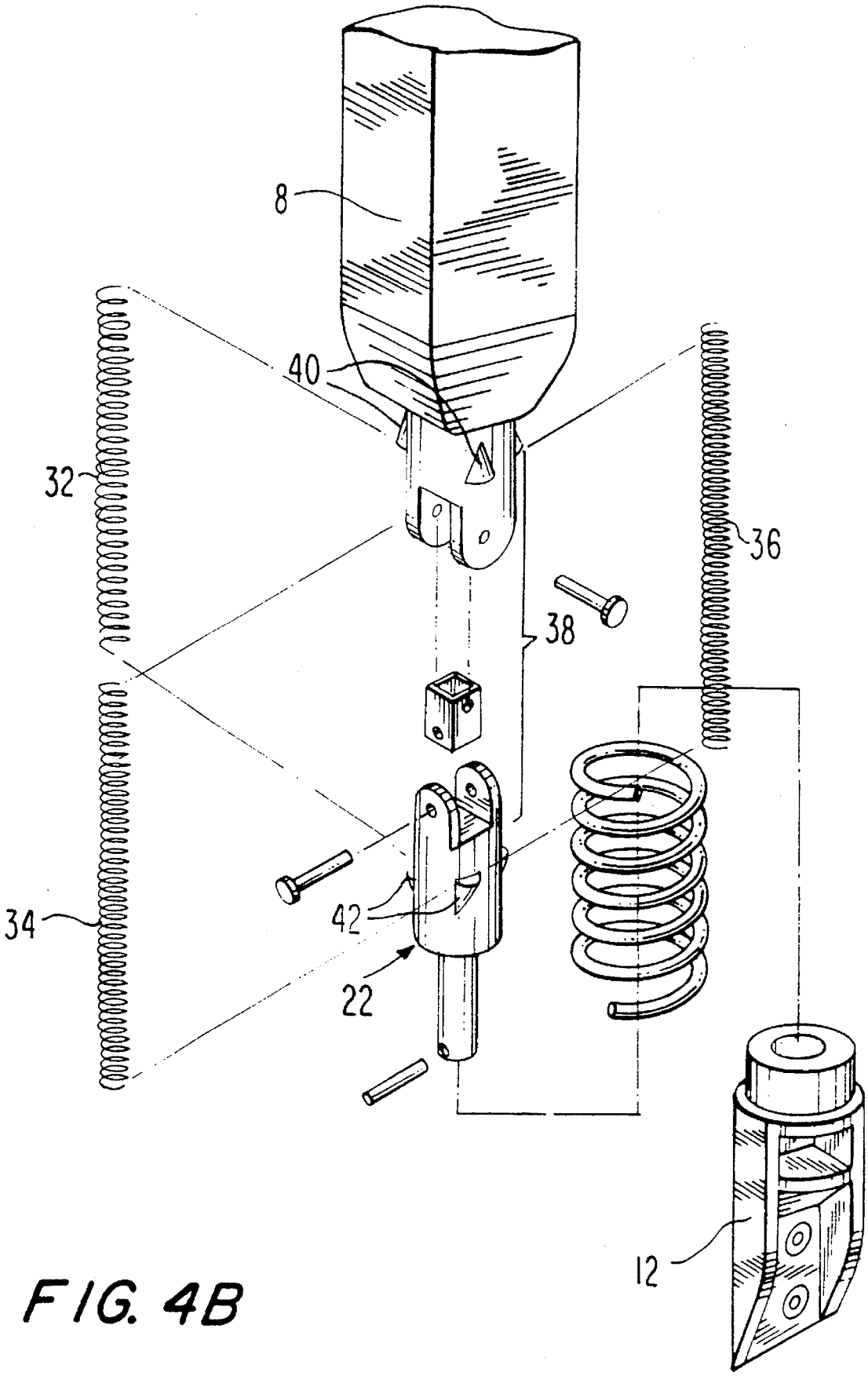
FIG. 4B is an elevated perspective exploded view of a third embodiment of the movement-accommodating assembly of the present invention.

FIG. 4B illustrates a third embodiment of a return pivot assembly in which a plurality of springs, as for example the elongated coil springs 32, 34, 36, are disposed along and radially outward from and collectively about the returnable universal joint pivot 38. Spring seats 40 are provided on one end of the rigid portion 8 and, more particularly (as illustrated in FIG. 4B), are defined on the outer surfaces of the arms of the element that has been identified as the first shaft portion 20 of the universal joint of FIG. 3. Each seat 40 receives and restrains one of the opposite ends of a respective coil spring 32, 34, 36. A like plurality of spring seats 42 are defined on the joint member 22 for receiving and restraining the opposite ends of the respective coil springs 32, 34, 36.

Figure 4C:
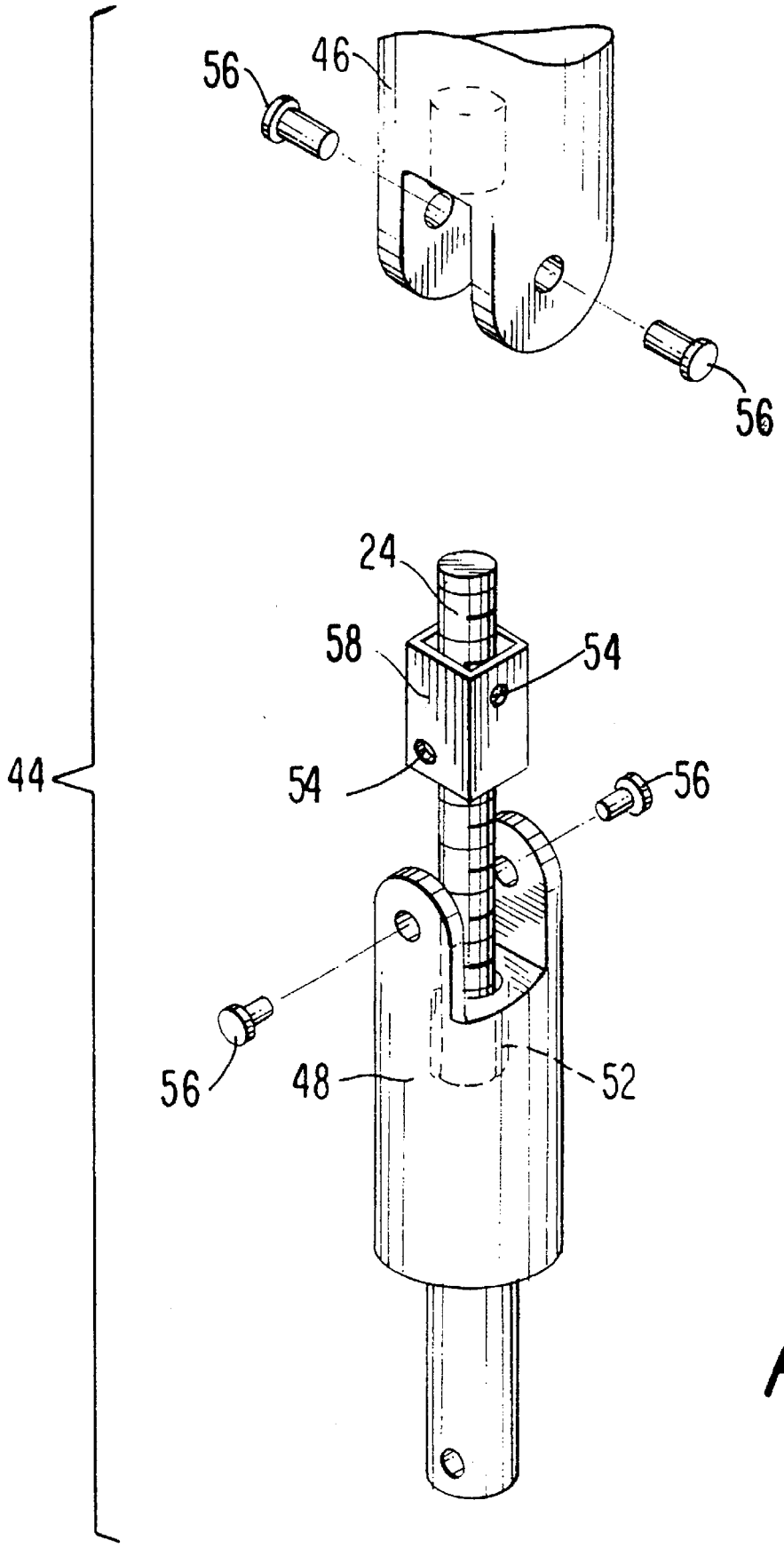
FIG. 4C is an elevated perspective exploded partial view of a fourth embodiment of the movement-accommodating assembly of the invention.

FIG. 4C depicts yet a fourth embodiment of a return pivot assembly in accordance with the present invention. A flexible pivot construction, as for example a universal joint 44, is coupled at opposite ends to the rigid portion 8 and to the support member 12 as generally described hereinabove. The universal joint 44 thus comprises a first coupling end 46 on the rigid portion 8 (not shown in FIG. 4C), a second coupling end 48 rotatably or otherwise coupled to the support 12, and an interposed yoke or multi-directional pivot connection 58. The yoke includes an axially central passage or channel in and through which an elongated coil spring 24 extends. The yoke 58 is also provided with bores 54 which enable the interposed yoke 58 to be movably secured to the respective coupling ends 46, 48 of the universal joint assembly 44 without interfering with the spring 24 using, by way of example, rivets 56 or the like. Additionally, the second coupling end 48 has a portion that defines a cavity 52 sized for accepting one end portion of the spring 24. In a similar fashion, the first coupling end 46 has a portion that defines a cavity, not visible in FIG. 4C, that is sized for accepting the opposite end portion of the spring 24. Thus, in this FIG. 4C embodiment the pivotable coupling assembly implemented by the universal joint 44 is disposed radially outward from and radially about the elongated return spring 24 which extends between the members 46, 48.

As should of course be apparent, like functionality may also be provided in the FIG. 4C embodiment by utilizing, as a general matter of design choice, other types and constructions of suitably-bored or configured couplings, as for example the ball and socket of FIG. 4A.

It will be further recognized that various additional alternate embodiments may be constructed in accordance with the teachings herein and utilizing a material that is flexible and extensible or deformable under tension and substantially automatically returns to its original shape and position when such tension is relieved—as for example a rubber-based material in lieu of, or in combination with, one or more springs. Where such a robber material is so employed, a suitable retention device or structure will be provided at the respective coupling ends 46, 48 to retain the respective ends thereof in the opposed cavities.

In operation, the user may grasp and selectively manipulate the handle to any desired position or orientation within the permitted volume A, thus applying a directional force to the movement assembly which causes displacement of the handle 4 from its first or unmanipulated (i.e. normal or storage) position (FIG. 1) to the user-defined second position for pulling the luggage in a user-determined direction along the underlying ground or supporting surface. The user-applied force and consequent movement of the handle from its first to its second position also loads or deforms the spring member(s) so that when the handle is subsequently released—i.e. when the user-applied loading or deformation force is relieved—the handle automatically returns under the urgency of the spring(s) to its first or unmanipulated position.

While there have been shown and described and pointed out fundamental novel features of the invention as applied to several preferred embodiments thereof, it will be understood that various omissions and substitutions and changes in the form and details of the devices illustrated, and in their operation, may be made by those skilled in the art without departing from the spirit of the invention. It is the intention, therefore, to be limited only as indicated by the scope of the claims appended hereto.

What is claimed is:

1. A handle assembly for selectively moving an article of luggage in a user-defined direction on and along an underlying supporting surface, the article of luggage including a top wall, a bottom wall adjacent and confrontingly opposite the underlying supporting surface, and a forward facing wall disposed between the top and bottom walls and defining a forward direction of movement of the article, said handle assembly comprising:

an elongated substantially rigid member carrying a graspable portion at one end of the member and graspable by a user for pulling the article of luggage so as to substantially move the article along the underlying supporting surface, said member being pivotally movable between a first position in which said member lies substantially along the forward facing wall and said graspable portion is disposed closely adjacent the forward facing wall, and a second position in which said one end of the member and said graspable portion are disposed in remotely spaced relation from the forward facing wall;

a support fixed to the forward facing wall proximate the bottom wall; and a movement assembly coupling a second end of said rigid member opposite said one end to said support for pivotal movement of said member relative to said support between said first and second positions, said movement assembly comprising coupling means for pivotally connecting the member second end and said support so as to accommodate said pivotal movement of said member between said first and second positions and at least one spring disposed spanningly between said member second end and said support and normally urging said member from said second to said first position so that when a user, selectively moving the article of luggage in a user-defined direction by grasping and pulling the graspable portion and thereby causing said elongated member to pivotally move from said first to said second position of the member, then releases the user's grasp of the graspable portion said member pivotally returns from said second to said first position without user intervention under the return urgency of said spring;

wherein said coupling means comprises a universal joint.

2. The handle assembly of claim 1, wherein said coupling means further connects the member second end and said support for axial rotation of said member relative to said support about an axis defined along the elongation of said member.

3. The handle assembly of claim 1, wherein said at least one spring comprises a coil spring that surrounds said coupling means.

4. The handle assembly of claim 1, wherein said at least one spring comprises a plurality of springs.

5. The handle assembly of claim 4, wherein said plurality of springs are coil springs are disposed radially outward from and collectively about said coupling means.

6. The handle assembly of claim 1, wherein said second position comprises a plurality of second positions collectively defining a swept volume of substantially half-hemispherical shape.

7. The handle assembly of claim 1, wherein said spring has an axis and said coupling means is disposed radially about said spring.

8. The handle assembly of claim 1, wherein said coupling means comprises a universal joint including a yoke having a passage through which said spring extends.

9. A handle assembly for selectively moving an article of luggage in a user-defined direction on and along an underlying supporting surface, the article of luggage including a top wall, a bottom wall adjacent and confrontingly opposite the underlying supporting surface, and a forward facing wall disposed between the top and bottom walls and defining a forward direction of movement of the article, said handle assembly comprising:

an elongated substantially rigid member carrying a graspable portion at one end of the member and graspable by a user for pulling the article of luggage so as to substantially move the article along the underlying supporting surface, said member being pivotally movable between a first position in which said member lies substantially along the forward facing wall and said graspable portion is disposed closely adjacent the forward facing wall, and a second position in which said one end of the member and said graspable portion are disposed in remotely spaced relation from the forward facing wall;

a support fixed to the forward facing wall proximate the bottom wall; and a movement assembly coupling a second end of said rigid member opposite said one end to said support for pivotal movement of said member relative to said support between said first and second positions, said movement assembly comprising coupling means for pivotally connecting the member second end and said support so as to accommodate said pivotal movement of said member between said first and second positions and at least one spring disposed spanningly between said member second end and said support and normally urging said member from said second to said first position so that when a user, selectively moving the article of luggage in a user-defined direction by grasping and pulling the graspable portion and thereby causing said elongated member to pivotally move from said first to said second position of the member, then releases the user's grasp of the graspable portion said member pivotally returns from said second to said first position without user intervention under the return urgency of said spring;

wherein said at least one spring comprises a plurality of springs.

10. The handle assembly of claim 9, wherein said plurality of springs are coil springs are disposed radially outward from and collectively about said coupling means.

11. The handle assembly of claim 9, wherein said coupling means further connects the member second end and said support for axial rotation of said member relative to said support about an axis defined along the elongation of said member.

12. The handle assembly of claim 9, wherein said coupling means comprises a ball and socket.

13. The handle assembly of claim 9, wherein said at least one spring comprises a coil spring that surrounds said coupling means.

14. The handle assembly of claim 9, wherein said second position comprises a plurality of second positions collectively defining a swept volume of substantially half-hemispherical shape.

15. The handle assembly of claim 9, wherein said spring has an axis and said coupling means is disposed radially about said spring.

16. A handle assembly for selectively moving an article of luggage in a user-defined direction on and along an underlying supporting surface, the article of luggage including a top wall, a bottom wall adjacent and confrontingly opposite the underlying supporting surface, and a forward facing wall disposed between the top and bottom walls and defining a forward direction of movement of the article, said handle assembly comprising:

an elongated substantially rigid member carrying a graspable portion at one end of the member and graspable by a user for pulling the article of luggage so as to substantially move the article along the underlying supporting surface, said member being pivotally movable between a first position in which said member lies substantially along the forward facing wall and said graspable portion is disposed closely adjacent the forward facing wall, and a second position in which said one end of the member and said graspable portion are disposed in remotely spaced relation from the forward facing wall;

a support fixed to the forward facing wall proximate the bottom wall; and a movement assembly coupling a second end of said rigid member opposite said one end to said support for pivotal movement of said member relative to said support between said first and second positions, said movement assembly comprising coupling means for pivotally connecting the member second end and said support so as to accommodate said pivotal movement of said member between said first and second positions and at least one spring disposed spanningly between said member second end and said support and normally urging said member from said second to said first position so that when a user, selectively moving the article of luggage in a user-defined direction by grasping and pulling the graspable portion and thereby causing said elongated member to pivotally move from said first to said second position of the member, then releases the user's grasp of the graspable portion said member pivotally returns from said second to said first position without user intervention under the return urgency of said spring;

wherein said spring has an axis and said coupling means is disposed radially about said spring.

17. The handle assembly of claim 16, wherein said coupling means further connects the member second end and said support for axial rotation of said member relative to said support about an axis defined along the elongation of said member.

18. The handle assembly of claim 16, wherein said second position comprises a plurality of second positions collectively defining a swept volume of substantially half-hemispherical shape.

* * * * *